United States Patent [19]

Genevois

[11] Patent Number: 4,884,061

[45] Date of Patent: Nov. 28, 1989

[54] CAPACITIVE APPARATUS TO MONITOR THE INTEGRITY OF A WALL

[75] Inventor: Christophe Genevois, Dijon, France

[73] Assignee: Axytel S.A., Dijon, France

[21] Appl. No.: 199,174

[22] Filed: May 26, 1988

[30] Foreign Application Priority Data

May 27, 1987 [FR] France ..... 87 07530

[51] Int. Cl.[4] ..... G08B 13/22

[52] U.S. Cl. ..... 340/550; 340/562

[58] Field of Search ..... 340/550, 562

[56] References Cited

U.S. PATENT DOCUMENTS

| | | | |
|---|---|---|---|
| 1,180,246 | 4/1916 | Cregier | 340/550 |
| 3,550,109 | 12/1970 | Kato | 340/562 |
| 3,633,194 | 1/1972 | Kothe | 340/550 |
| 3,763,795 | 10/1973 | Wetz, Jr. | 340/550 |
| 4,169,260 | 9/1979 | Bayer | 340/562 |

FOREIGN PATENT DOCUMENTS

| | | |
|---|---|---|
| 3315831 | 10/1984 | Fed. Rep. of Germany . |
| 3527873 | 5/1987 | Fed. Rep. of Germany . |
| 2269157 | 11/1975 | France . |
| 2450464 | 9/1980 | France . |

*Primary Examiner*—Glen R. Swann, III

*Attorney, Agent, or Firm*—Sandler & Greenblum

[57] ABSTRACT

An apparatus for verifying the integrity of a wall automatically sets off an intervention in the case of an act committed against the wall. A capacitive sensor is formed on the external or internal surface of the wall and consists of a thin planar condenser matching the shape of the wall. An oscillator having variable frequency has its control input connected to a plate of the condenser, the other plate being connected to ground, and a circuit detects the variation of frequency of the output signal of the oscillator resulting from a variation of condenser capacitance.

11 Claims, 1 Drawing Sheet

CAPACITIVE APPARATUS TO MONITOR THE INTEGRITY OF A WALL

BACKGROUND OF THE INVENTION

1. Field of the Invention

The present invention relates to a monitoring apparatus for verifying the integrity of any wall, metallic or nonmetallic, and is adapted to automatically set off an intervention in the case of an act committed against this wall.

2. Description of Background and Relevant Information

There presently exists a large number of articles produced, documents, or valuable articles which must be protected. Examples are bank notes, checks or check books, credit cards or other cards usable as money, secret documents, microfilm, magnetic and/or optical recordings, etc. All of these objets to be protected are generally stored in safety containers, such as enclosures which are each defined by a wall separating the environment from the internal volume in which the protected objects are stored.

SUMMARY OF THE INVENTION

The present invention relates to an apparatus making it possible to permanently monitor the state of such a wall and to automatically control an intervention, as soon as an aggression is committed against this wall, this intervention being, for example an alteration or even a destruction of the objects located within the protected container.

The invention comprises, on the external or internal surface of the wall, a capacitive sensor constituted by a thin planar condenser matching the shape of the wall and, on the internal side of this wall, an electronic surveillance circuit comprising a variable frequency oscillator, to the control input of which is connected a plate of the condenser carried by the surface of the wall and whose other plate is connected to ground, and means for detecting the variation of frequency of the output signal of the oscillator resulting from a variation in capacitance of the condenser, and for then delivering an alarm signal when an external aggression on the wall causes a variation of the surface of the condenser carried by this wall and consequently the capacitance thereof.

Preferably, the external plate of the condenser pressed against the wall is connected to ground and this plate serves as a Faraday cage protecting the electronic surveillance circuit with respect to external radio electric aggressions.

According to a further characteristic of the invention, the electronic surveillance circuit comprises a temperature detection probe placed in the vicinity of the internal surface of the wall and this temperature detection probe is connected to a temperature correction circuit to provide compensation for variations of temperature, in a range preferably from −40° C. to +60° C.

BRIEF DESCRIPTION OF THE DRAWINGS

The invention will be described below, by way of non-limiting examples, with reference to the annexed drawings in which.

DESCRIPTION OF THE PREFERRED EMBODIMENTS

Figure 1:
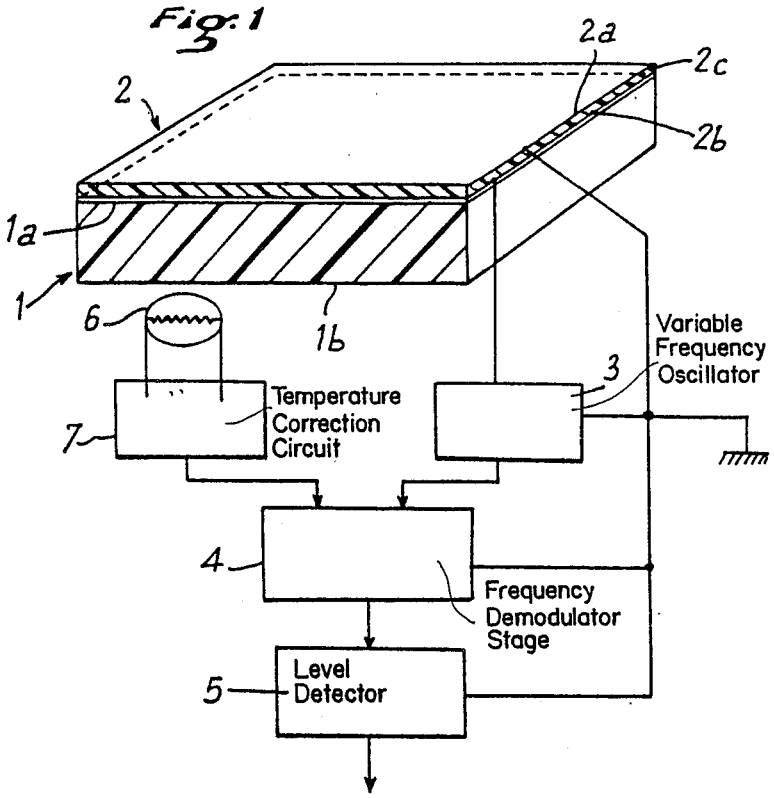
FIG. 1 is a diagram of an apparatus for monitoring the integrity of a wall according to the invention.

The apparatus, according to the invention which is shown in its entirety in FIG. 1, is adapted to permanently monitor the integrity of a wall 1. This wall forms a surface which is or is not closed on itself, to define a safety enclosure containing objects which must be protected. The apparatus utilizes an external capacitive sensor formed as a planar condenser 2 which is applied directly or indirectly on the external surface 1*a* of the wall 1. This condenser comprises an external metallic plate 2*a*, an internal metallic plate 2*b* in contact with the external surface 1*a* of the wall 1 and an intermediate dielectric layer 2*c*, in the case where this wall 1 is made of a non-metallic material. If the wall 1 is metallic, it can itself serve as a plate which is then coated with an adhesive and insulation lacquer separating it from the external plate 2*a*. Preferably, the external plate is grounded in a manner so as to constitute a Faraday cage surrounding and protecting the various elements constituting the electronic circuit, which will be described below. This condenser is utilized as a surface integrity sensor, it being given that the capacitance of the condenser is directly proportional to the instantaneous area of the surface of the condenser plates, if one assumes that the thickness of the dielectric layer 2*c* is constant. According to the invention, one utilizes this property to detect an aggression against the wall, the aggression being indicated by a variation in the metallic surface of condenser 2. This aggression can be of two different types, namely a slow aggression, for example as a result of elevation of local temperature by means of a blowtorch, so as to pierce the wall and a rapid aggression, for example, as a result of the impact of a bullet perforating condenser 2 and the wall 1, the reduction of the surface area of condenser 2 resulting from the hole made by the bullet.

The apparatus according to the invention utilizes, for detecting the aggression committed against wall 1, a variable frequency oscillator 3 at the input of which is connected condenser 2 having a capacitance which varies in response to potential aggressions. More particularly, the internal plate 2*b* is connected to the input of variable frequency oscillator 3, it being given that the external plate 2*a* constitutes a ground plane for all of the electronic circuits. The variable frequency oscillator 3 delivers at its output an alternating frequency signal f which is inversely proportional to the capacitance C of condenser 2, otherwise stated $f=k/C$, k being constant. In this embodiment, the output of the variable frequency oscillator 3 is connected to an input of a frequency demodulator stage 4 whose output is itself connected to a level detector 5. The frequency demodulator 4 is preferably constituted by a circuit having a phase lock loop. One then adjusts the oscillation frequency of this phase lock loop on the variable frequency oscillator 3 and all of the frequency offsets are then caught up by the control of the phase look loop. One thus obtains, at the output of the frequency demodulator 4, an amplitude signal which is proportional to the spacing of the frequency with respect to the reference frequency.

In fact, one distinguishes in practice two types of aggression namely:

(a) the rapid crossing of wall 1 or rapid aggression which creates, in the output signal of the variable frequency oscillator 3, a sudden offset in phase in a period;

(b) the slow aggression or wear (for example attack by chemical product of low reaction velocity of a blowtorch) which translates into a progressive frequency offset in time and which is directly proportional to the variation of the area of surface 2*a* of condenser 2. These two types of aggression can be detected by a single circuit namely, the frequency demodulator 4. The demodulator 4 is connected to the level detector 5 which can be constituted by an operational amplifier with a window having two detection levels. In fact an aggression by boring or wearing causes a diminution of the surface S and thus the capacitance C of the condenser 2, while on the contrary, a thermal aggression (by a blowtorch, for example) causes, in the first place, an increase in the surface S and of the capacitance C as a result of the dilation of the metallic plates of the condenser 2, which results in the necessity of having two detection thresholds. The output signal of the operational amplifier causes, as soon as one of the two thresholds is crossed, the engaging of a circuit, such as a flip-flop in a logic circuit so that the crossing of one of the thresholds is translated by the engaging of the circuit and the emission of a corresponding signal. Furthermore, the engaging of this circuit assures the storage and memory of this aggression.

The output signal of the level detector 5 can be utilized for various purposes, for example, to cause the destruction or at least the irremediable alteration of the objects protected by the wall 1 (destruction or coloration of bank notes, for example).

The apparatus according to the invention, comprises an apparatus which assures the correction of the frequency measurement with respect to the room temperature which itself causes a expansion or contraction of surface S of condenser 2 and would therefore cause a variation of capacitance C. The temperature correction apparatus comprises a temperature detection sensor 6 which is situated immediately adjacent the internal surface 1*b* of the wall 1. This sensor 6 is connected to a temperature correction circuit 7 which is itself connected to frequency demodulator 4. The circuit 7 intervenes to take into account the slow variations of ambient temperature, by distinguishing them from the rapid variations due to a thermal aggression. For this reason, the circuit 7 has a slower response time than the condenser 2 so as to be able to effect this difference.

Figure 2:
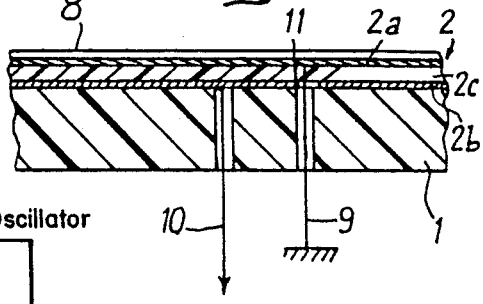
FIG. 2 is a cross-sectional view of the wall carrying the capacitive sensor, formed as a planar condenser.

As can be better seen in FIG. 2, the condenser 2 formed on the external surface 1*a* of the wall 1 can be obtained by application of a first layer of metal (for example aluminum), by vacuum metallization or galvanoplasty, to constitute the internal plate 2*b* of the condenser, then application of an insulating varnish layer of constant thickness to constitute the intermediate dielectric layer 2*c*; then application of a second metallic layer, by metallization under vacuum or galvanoplasty, to constitute the external plate 2*a* of the condenser 2; and finally, application of an exterior varnish protection layer 8. The electric connection of the two metallic plates 2*a* and 2*b* to the internal electronic circuit can occur easily, in the manner illustrated, by means of conductor wires 9, 10 passing through holes bored in the wall 1. The wire 9 passes through a hole 11 formed in the metallic layer 2*b* constituting the internal plate, when this layer is made, thanks to the provision, at the location of hole 11, of an appropriate guide. The wire 9 consequently traverses the internal plate 2*b* without being in contact with it. The other wire 10 is connected directly to the internal plate 2*b*. The varnish 2*c* constituting the intermediate dielectric layer is selected so as to have a similar expansion-contraction coefficient as that of wall 1 supporting the condenser 2 forming the sensor.

Figure 3:
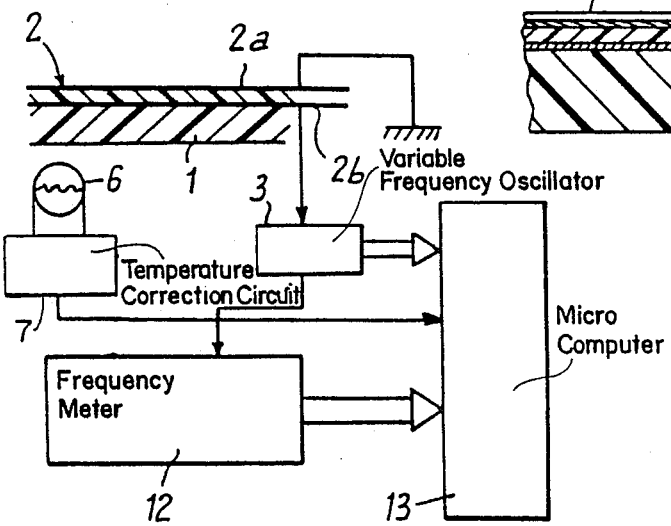
FIG. 3 is a diagram of an alternative embodiment of the apparatus.

In the embodiment of the invention shown in FIG. 3, the condenser 2 is supposed to be used only as a wear detector. In this case one can utilize, in place of the frequency demodulator stage 4, a frequency meter 12 connected, by an interface, to a microcomputer 13 which analyzes by its program, the frequency offsets. In this embodiment of the invention, the level detector 5 is likewise unnecessary because the detection thresholds are defined by the program of the microcomputer 13. Furthermore the temperature correction circuit 7 is connected to the microcomputer 13 which corrects the frequency with respect to the temperature.

Of course, the invention is not limited to the embodiments described and shown by way of examples, but includes all equivalent techniques as well as their combinations.

I claim:

1. An apparatus for verifying the integrity of a wall having internal and external surfaces and adapted to cause an intervention when an aggressive act is committed against the wall, said apparatus comprising, (a) a sensor mounted on one of the external or internal surfaces of the wall, said sensor being a condenser having a surface area substantially matching the shape of the wall and having a first plate connected to the wall and a second plate connected to ground;

(b) an electronic surveillance circuit on the internal side of the wall comprising a variable frequency oscillator having a control input connected to said first plate;

(c) means for detecting variation of frequency of an output signal of the variable frequency oscillator resulting from a variation in capacitance of the condenser, and for emitting a signal when an aggressive act on the wall causes a variation in surface area of the condenser which causes a variation in capacitance of the condenser.

2. The apparatus according to claim 1, wherein said second plate is connected to ground so that it serves as a Faraday cage to protect the electronic surveillance circuit from external forces.

3. The apparatus according to claim 1, wherein said means for detecting the variation of frequency comprises a frequency demodulator electrically connected to said variable frequency oscillator, and a level detector having two thresholds connected to the output of said frequency demodulator for emitting said signal.

4. The apparatus according to claim 1, wherein the means for detecting the variation of frequency comprises a frequency meter connected to a microcomputer to analyze the variation in frequency.

5. The apparatus according to claim 1, and further comprising a temperature detection probe located adjacent to the internal surface of the wall, said probe being connected to a temperature correction circuit, said temperature correction circuit being connected to said means for detecting the variation of frequency of an output signal of the oscillator.

6. The apparatus according to claim 1, wherein said first plate is formed by a first layer of metal, an insulating varnish layer forming an intermediate dielectric layer, said second plate being formed by a second layer of metal, and said second plate being covered by a layer of an exterior protective varnish.

7. The apparatus according to claim 6, wherein said layers of metal are applied by vacuum metallization.

8. The apparatus according to claim 6, wherein said layers of metal are applied by galvanoplasty.

9. An apparatus for verifying the integrity of a wall having internal and external surfaces and to determine when an aggressive act is committed against the wall, said apparatus comprising:

(a) a sensor mounted on one of the external or internal surfaces of the wall, said sensor being a condenser having a surface area substantially matching the shape of the wall and having a first plate connected to the wall and a second plate connected to ground;

(b) an electronic surveillance circuit comprising means for generating a variable frequency connected to said first plate;

(c) means for detecting variation of frequency of an output signal of said means for generating a variable frequency resulting from a variation in capacitance of the condenser when an aggressive act on the wall causes a variation in surface area of the condenser which causes a variation in capacitance of the condenser.

10. The apparatus according to claim 9, wherein said second plate is connected to ground so that it serves as a Faraday cage to protect the electronic surveillance circuit from external forces.

11. The apparatus according to claim 9, and further comprising a temperature detection probe located adjacent to the wall, said probe being connected to a temperature correction circuit being connected to said means for detecting the variation of frequency of an output signal.

* * * * *